United States Patent [19]

Medow

[11] 4,223,490

[45] Sep. 23, 1980

[54] SPACING MEANS FOR WALL PANELS

[76] Inventor: Robert S. Medow, 1251 NW. 165th St., Miami, Fla. 33169

[21] Appl. No.: 30,069

[22] Filed: Apr. 13, 1979

[51] Int. Cl.[3] ..... E04D 1/00

[52] U.S. Cl. ..... 52/98; 52/314; 52/521; 52/546; 52/553

[58] Field of Search ..... 52/314, 316, 521, 546, 52/98, 553, 529, 531, 539

[56] References Cited

U.S. PATENT DOCUMENTS

| | | | |
|---|---|---|---|
| 2,735,143 | 2/1956 | Kearns | 52/553 X |
| 3,217,453 | 11/1965 | Medow | 52/314 |
| 3,504,467 | 4/1970 | Hatch et al. | 52/521 X |
| 3,621,625 | 11/1971 | Medow | 52/314 |
| 3,968,610 | 7/1976 | Medow | 52/539 X |
| 4,102,106 | 7/1978 | Golder et al. | 52/546 X |

*Primary Examiner*—Price C. Faw, Jr.
*Assistant Examiner*—Carl D. Friedman

[57] ABSTRACT

Spacing means for wall panels for preventing the buckling of said panels due to changes in climatic temperature, the panels having slotted portions along a top edge and one side thereof for receiving a flange mounted along the bottom edge and the other side of an adjacent panel, the improvement consisting of breakable spacing members extending at approximately right angle to the panel and mounted in proximity of the slotted portions whereby upon mounting one panel upon another, the spacing members of the upper panel engages and rests on the top edge of the flange of the lower panel in predetermined spaced relation to the upper edge portion of the slotted portion, said space permitting the expansion due to temperature changes of the panels without buckling same.

4 Claims, 5 Drawing Figures

SPACING MEANS FOR WALL PANELS

BACKGROUND OF THE INVENTION

1. Field of the Invention

This invention relates to panel structures and is particularly directed to spacing means mounted on the panels.

2. Description of the Prior Art

Since wall panels are subject to expansion and contraction due to climatic temperature changes, a space must be provided between the edges of adjacent panels when mounted on a wall to prevent buckling of the panels when they expand and the exposing of the wall when the panels contract. Therefore, a definite and predetermined measured space is required between panels. This is accomplished by placing an article of the desired size between the panels as they are mounted on the wall and then removed after the panels have been fastened to the wall. This operation is not only time consuming but there is also the danger of forgetting to remove the spacers. The present invention avoids these objections by providing means permanently mounted on the rear surface of the panels and breakaway when the panels expand.

SUMMARY OF THE INVENTION

Therefore a principal object of the present invention is to provide wall panels with spacing members extending outwardly on the rear surface thereof that permits mounting the panels on a wall in an overlapping position but allowing space therebetween for expansion of the panels to prevent the buckling of the panels due to changes in climatic temperature.

Another object of the present invention is to provide wall panels with spacing members that are readily broken away by the expansion of panels due to changes in climatic temperatures to permit the proper expansion of the panels without buckling.

A still further object of the present invention is to provide wall panels with spacing members permanently attached to the rear surface of the panels that permit a predetermined and proper spacing between panels whereby upon expansion of the panels, the latter will expand without buckling and contract without exposing the wall upon which the panels are mounted.

With these and other objects in view, the invention will be best understood from a consideration of the following detailed description taken in connection with the accompanying drawing forming a part of this disclosure, with the understanding, however, that the invention is not confined to any strict conformity with the showing of the drawing but may be changed or modified so long as such changes or modifications mark no material departure from the salient features of the invention as expressed in the appended claims.

DESCRIPTION OF THE PREFERRED EMBODIMENT

Figure 1:
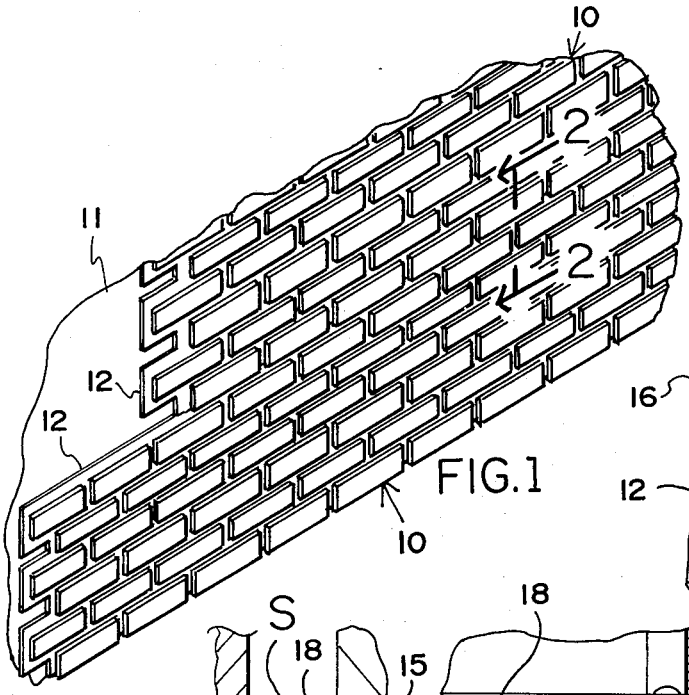
FIG. 1 is a fragmentary perspective view of a wall upon which a facing constructed of my panels is shown.
Figure 5:
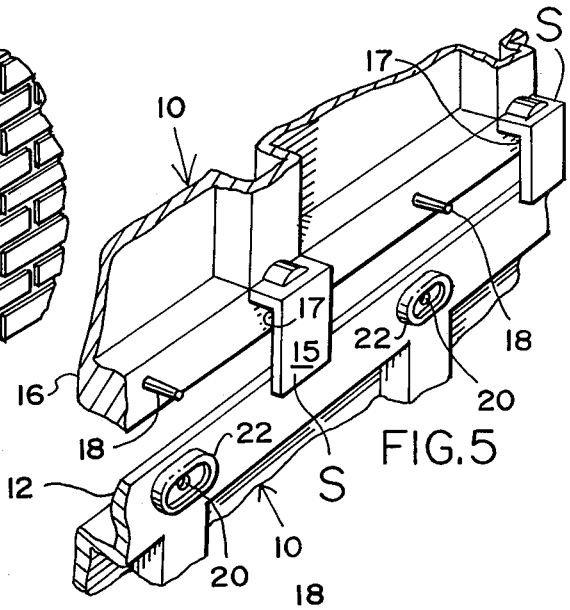
FIG. 5 is an exploded view of the panels as seen from the rear.
Figure 3:
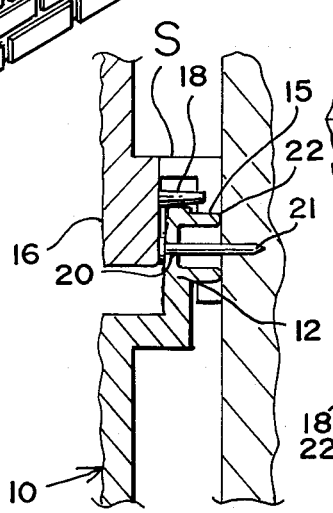
FIG. 3 is a fragmentary rear view of the interlocking panels shown in FIG. 1.
Figure 3:
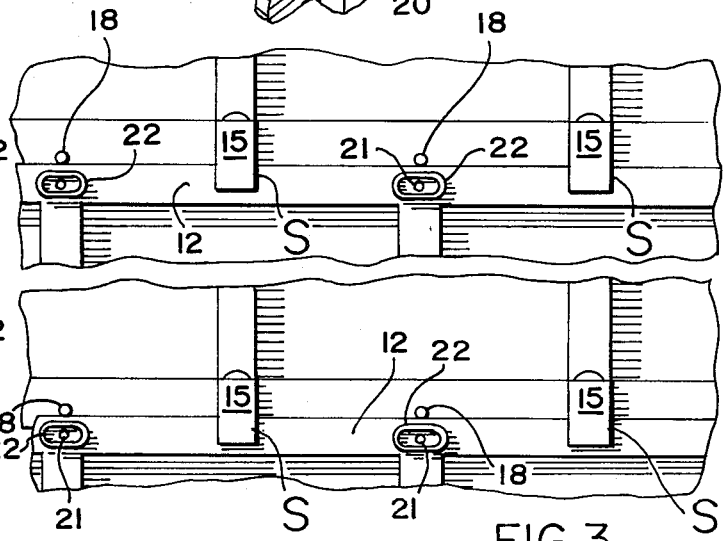
Figure 2:
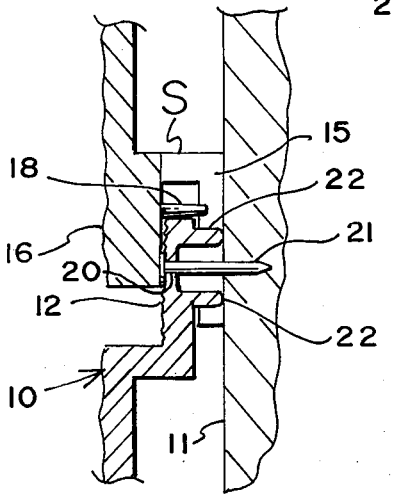
FIG. 2 is a cross sectional view taken along the line 2—2 of FIG. 1.

Referring to the drawing wherein like numerals are used to designate similar parts throughout the several views, the number 10 refers to the panels of identical construction which when assembled and erected on the wall 11 of a building provide a new facing for the building as described in detail in my U.S. Pat. No. 3,217,453 issued Nov. 16, 1965 for Facing Structure And Article, No. 3,621,625 issued on Nov. 23, 1971 for Brick Siding and No. 3,968,610 issued July 13, 1976 for Facing Structures For Building.

It has been determined that a spacing must be provided between the panels 10 that will permit the overlapping panels 10 to expand and contract with changes in climatic temperature without causing the panels to buckle on the wall 11. The overlapping flange of one panel 10 is found to be insufficient to cover the adjacent panel when the panels contract due to a drop in temperature and a gap occurs between the panels 10 to uncover the wall 11. On the other hand, the overlapping flange of one panel 10 will cause adjacent panels to buckle if the overlapping flange covers the flange of the adjacent panel 10 but is not spaced sufficiently to permit the expansion of the panels 10 when the temperature of the climate rises.

The panels 10 which consist of a facing resembling brick, stone or the like are provided with a flange 12 along the top edge and one side and a plurality of relatively narrow slotted portions -S- along both the bottom edge and the other side of the panels 10. Each of the slotted portions -S- consist of a depending flange 15 which abuts against the wall 11 and a second flange 16 extending the full length of the panel 10 and spaced from the wall engaging flange 12 to form a slot 17 which receives the flange 12 of an adjacent panel 10 to interlock the panels 10 on the wall 11.

Extending rearwardly from the flanges 16 at approximately right angle are cylindrical spacing members 18 which lie in the path of the flange 12 of the adjacent panel as the flange 12 of one panel 11 is inserted into the slot 17 of an adjacent panel 11. The function of the spacing members 18 is to permit the flange 12 to be positioned in the slot 17 at a predetermined distance within the slot 17 to provide the proper amount of space for expansion and contraction of the panels 10.

The flanges 12 are provided with a plurality of openings 20 for receiving nails 21 and the like for fastening the panels 10 to the wall 11. About the openings 20 is an oval shaped-raised surface 22 which engages the wall 11 when the panels 10 are mounted on the wall 11 to space the flange 12 from the wall 11.

When the wall 11 is to be resurfaced with the panels 10, the first panel 10 at the lowermost portion of the wall 11 is mounted on the wall and fastened thereto by nailing nails 21 through the flanges 12 on the side and top of the panel 10. Then the second panel 10 is placed alongside the fastened panel 10 with its slotted portions -S- interlocking with the flanges 12 of the fastened panel 10 and its flanges 12 on the side and top are then nailed to the wall 11. The spacer members 18 of one of the panels 10 engage the flange 12 of the adjacent panel 10 to provide the predetermined space between panels 10. When the panels 10 of the first row have been erected, then the second row is commenced by placing the slotted portions -S- of the upper panels in interlocking relation with the flanges 12 of the lower panels 10. The spacer members 18 of the upper panels 10 engage the flanges 12 to provide the predetermined spacing between the rows of panels 10.

Figure 4:
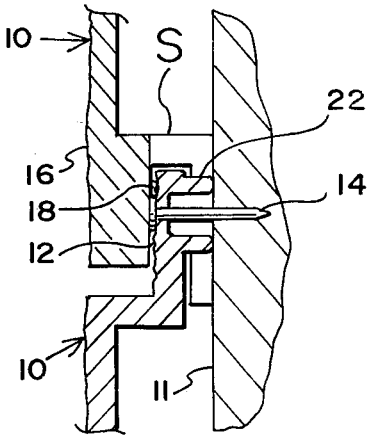
FIG. 4 is a view similar to FIG. 2 with the panels in an expanded position.

Upon the expansion of any of the panels 10 due to increase in climatic temperature, the top edges of flanges 12 of the panels 10 are free to move against and break the spacing members 18 as the flanges 12 slide upwardly in the slots 17 as shown by FIG. 4. Had there not been a proper space provided for expansion of the panels 10, the latter would buckle away from the wall and become unsightly. Upon a drop in climatic temperature, the panels 10 will contract in a direction away from each other. However, the spacing between the panels are predetermined that not only permit the panels 10 to expand without buckling but also to contract due to a drop in temperature yet not expose any of the wall 11 on which the panels 10 are mounted.

What I claim as new is:

1. In a plurality of panels for covering walls having an outer surface simulating brick, stone and the like, the combination comprising a slotted portion mounted along one edge of each of said panels and a flange portion mounted along a second edge of said each of said panels and a plurality of substantially breakable spacing members mounted in said slotted portion whereby upon the mounting of said panels on a wall, said flange portion of one of said panel is received in said slotted portion of an adjacent panel in abutting relation with said spacing members whereby upon the expansion of said panels, said spacing members will be broken away and said panels will expand in a direction toward each other.

2. The structure as recited by claim 1 wherein said spacing members comprise substantially cylindrical members extending across said slotted portion.

3. The structure as recited by claim 2 taken in combination with a second slotted portion mounted along a third edge of each of said panels and a second flange portion on a fourth edge of each of said panels, said second slotted portion having substantially cylindrical members extending across said second slotted portion as spacing members.

4. The structure as recited by claim 3 and openings formed on said flange portions for receiving a fastening member therethrough and a raised surface mounted about said openings for mounting said panels in spaced relation to said wall.

* * * * *